US009256177B2

(12) United States Patent
Watanabe

(10) Patent No.: US 9,256,177 B2
(45) Date of Patent: Feb. 9, 2016

(54) IMAGE FORMING APPARATUS WITH A CAM CONFIGURED TO CHANGE A PRESSURIZING FORCE APPLIED TO A ROTATION MEMBER, AND A CONTROL UNIT CONFIGURED TO CONTROL A MOTOR SPEED FOR DRIVING THE CAM

(71) Applicant: CANON KABUSHIKI KAISHA, Tokyo (JP)

(72) Inventor: Tatsuhito Watanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/016,991

(22) Filed: Sep. 3, 2013

(65) Prior Publication Data

US 2014/0064763 A1 Mar. 6, 2014

(30) Foreign Application Priority Data

Sep. 6, 2012 (JP) ..... 2012-195669

(51) Int. Cl.
*G03G 15/20* (2006.01)

(52) U.S. Cl.
CPC ..... *G03G 15/2067* (2013.01); *G03G 15/2032* (2013.01)

(58) Field of Classification Search
CPC ..... G03G 15/2032; G03G 15/2067
See application file for complete search history.

(56) References Cited

U.S. PATENT DOCUMENTS 6,731,901 B2 5/2004 Nishitani et al.
2003/0128994 A1* 7/2003 Holubek ..... G03G 15/2064 399/45
2005/0025511 A1* 2/2005 Watabe ..... G03G 15/2032 399/67
2008/0107436 A1* 5/2008 Mikutsu ..... G03G 15/206 399/67
2010/0119247 A1* 5/2010 Seol ..... G03G 15/206 399/67
2010/0202808 A1* 8/2010 Russel ..... G03G 15/2032 399/328
2011/0176821 A1* 7/2011 Hase ..... G03G 15/6576 399/45
2012/0003019 A1* 1/2012 Yokoyama ..... G03G 15/2035 399/323
2012/0148304 A1* 6/2012 Sugaya ..... G03G 15/2053 399/122
2012/0263487 A1* 10/2012 Itaya ..... G03G 15/2053 399/68

FOREIGN PATENT DOCUMENTS

JP 2002-268414 A 9/2002
JP 2003-280308 * 10/2003
JP 2005-114959 A 4/2005
JP 2013-113932 * 6/2013

* cited by examiner

*Primary Examiner* — Clayton E LaBalle
*Assistant Examiner* — Peter L Cheng
(74) *Attorney, Agent, or Firm* — Canon U.S.A., Inc. IP Division

(57) ABSTRACT

A fixing device causes an eccentric cam to perform a rotation step of 113° to shift from a pressurization releasing mode to a pressurization mode, and causes the eccentric cam to perform a rotation step of 263° to shift from a standby mode to the pressurization mode. A control unit activates a motor by setting a rotational speed of a rotational magnetic field of a stator to 600 rpm in the rotation step of 113° and to 1500 rpm in the rotation step of 263° so as to prevent the eccentric cam from receiving acceleration of a rotational direction from a pressure lever before a rotational speed of a rotor reaches a first rotational speed. Then, the control unit stops the rotational magnetic field of the stator based on an output of a photo interrupter.

10 Claims, 15 Drawing Sheets

AXIS VERTICAL CROSS-SECTIONAL DIAGRAM

AXIS PARALLEL CROSS-SECTIONAL DIAGRAM

PEAK ARRANGEMENT

ROTATIONAL ANGLE OF ECCENTRIC CAM

PRESSURIZING MODE

PRESSURIZING REDUCTION MODE

PRESSURIZING RELEASING MODE

PRESSURIZING-PRESSURIZING RELEASING OPERATION TIME (BACKWARD DIRECTION ROTATION)

IMAGE FORMING TIME (FORWARD DIRECTION ROTATION)

DISASSEMBLED STATE

ASSEMBLED STATE

URGING MEMBER

ASSEMBLED STATE

PRESSURIZING MODE

PRESSURIZING REDUCTION MODE

N1 > N2

IMAGE FORMING APPARATUS WITH A CAM CONFIGURED TO CHANGE A PRESSURIZING FORCE APPLIED TO A ROTATION MEMBER, AND A CONTROL UNIT CONFIGURED TO CONTROL A MOTOR SPEED FOR DRIVING THE CAM

BACKGROUND OF THE INVENTION

1. Field of the Invention

The present invention relates to an image forming apparatus that controls a pressing force of a nip portion formed by a first rotation member for heating a recording medium having an image formed thereon and a second rotation member.

2. Description of the Related Art

There is widely used an image forming apparatus that transfers a toner image formed on an image bearing member to a recording material directly or via an intermediate transfer member, and heats and applies pressure on the recording medium to which the toner image has been transferred by a nip portion of a fixing device as an example of an image heating device to fix the image on the recording medium. The image heating device forms a nip portion of the recording medium by press-contacting a press contact rotation member (belt member or roller member) having an elastic layer with a heating rotation member (belt member or roller member). In the image heating device, to prevent deformation of the elastic layer, the press contact rotation member is desirably separated from the heating rotation member during stop period (as discussed in Japanese Patent Application Laid-Open No. 2005-114959).

Japanese Patent Application Laid-Open No. 2005-114959 discusses a mechanism for releasing the pressure of the nip portion applied by a spring member by rotating a cam member via a motor. The pressure of the nip portion is reduced or released during a period where heating processing of the recording medium is not performed.

Japanese Patent Application Laid-Open No. 2005-114959 discloses an image heating device that selects and executes a pressurization mode for performing fixing processing, a pressurization releasing mode for releasing pressure of a nip portion during stop period, and a pressurization reducing mode for setting image formation standby in a state where a pressurizing force is reduced.

The applicant has discovered that when the cam member receives acceleration in a speed increasing direction from the surrounding mechanism, a rotor rotates at a speed equal to or higher than a rotational speed of a rotating magnetic field of a stator, and then the cam member overruns when it is braked to stop.

SUMMARY OF THE INVENTION

The present invention is directed to enabling a cam member driven to rotate by a motor to stop at a predetermined position, and highly accurately perform a switching operation of a pressurizing force of a nip portion.

According to an aspect of the present invention, an image forming apparatus includes an image forming unit configured to form an image on a recording medium, a first rotation member configured to heat the recording medium on which the image has been formed, a second rotation member, a pressurization unit configured to apply pressure on the first rotation member or the second rotation member so as to apply pressure on a nip portion formed by the first rotation member and the second rotation member, a cam configured to receive pressure applied from the pressurization unit according to a rotational position, and change a pressurizing force applied to the first rotation member or the second rotation member from the pressurization unit according to the rotational position, a motor configured to drive the cam to rotate, and a control unit configured to, in a first mode of rotating the cam from a first rotational position to a second rotational position, control the motor to rotate at a first rotational speed, and in a second mode of rotating the cam from a third rotational position to the second rotational position, control the motor to rotate at a second rotational speed lower than the first rotational speed. In this case, a rotational angle from the first rotational position to the second rotational position is larger than that from the third rotational position to the second rotational position, and a pressurizing force of the pressurization unit at the second rotational position is larger than those of the pressurization unit at the first and third rotational positions.

Further features and aspects of the present invention will become apparent from the following description of exemplary embodiments with reference to the attached drawings.

DESCRIPTION OF THE EMBODIMENTS

Figure 1:
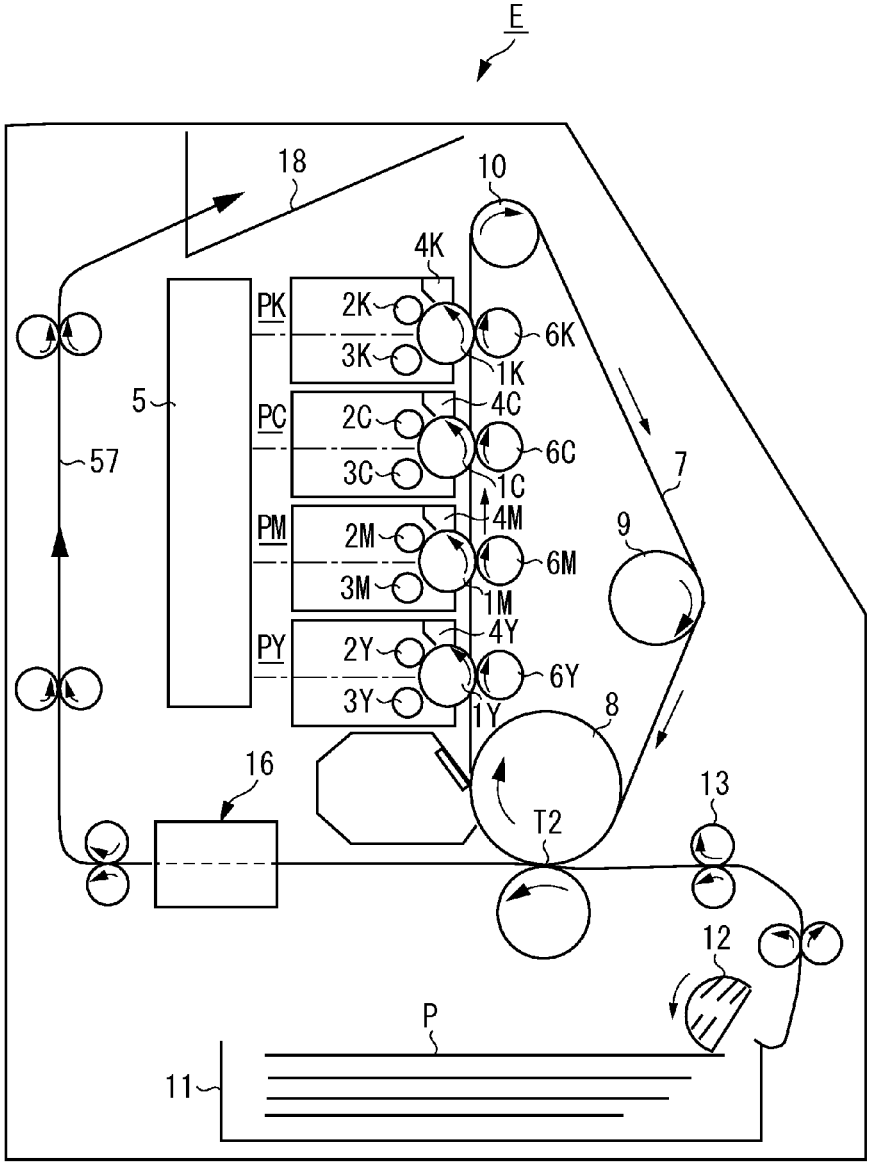
FIG. 1 is an explanatory view illustrating a configuration of an image forming apparatus.

Hereinafter, an exemplary embodiment of the present invention will be described in detail referring to the drawings. The present invention can be implemented by another embodiment where some or all components of the exemplary embodiment are replaced with alternative components as long as a rotational speed of a rotating magnetic field of a stator of a motor for driving a cam member can be switched at two stages or more.

Thus, a heating rotation member and a press contact member are not limited to belt members and at least one of the members may be a roller member. An image heating device may be included in an image forming apparatus or an optional unit combined with a single image heating processing device or an image forming system. As long as an image borne on a recording medium is heated, the image heating device may be a fixing device, a gloss processing device of an image surface, or a curl removing device of the recording medium.

The image forming apparatus can be implemented irrespective of a full color or a monochrome, a one-drum type or a tandem type, a recording medium conveyance method or an intermediate transfer method, a type of an image bearing member, a charging method, an exposure method, a transfer method, and a fixing method. In the present exemplary embodiment, only a main portion concerning forming/transferring of a toner image will be described. However, by adding necessary devices, units, and a case structure, the present invention can be applied in various ways, for example, as a printer, various printing machines, a copying machine, a facsimile, or a multifunction peripheral.

(1) Example of Image Forming Apparatus

FIG. 1 is a diagram illustrating a configuration of an image forming apparatus. As illustrated in FIG. 1, the image forming apparatus E is a full-color printer of a tandem type intermediate transfer method where image forming units PY, PM, PC, and PK of yellow, magenta, cyan, and black are arranged along an intermediate transfer belt 7.

In the image forming unit PY, a yellow toner image is formed on a photosensitive drum 1Y to be transferred to the intermediate transfer belt 7. In the image forming unit PM, a magenta toner image is formed on a photosensitive drum 1M to be transferred to the intermediate transfer belt 7. In the image forming units PC and PK, a cyan toner image and a black toner image are formed on photosensitive drums 1C and 1K to be transferred to the intermediate transfer belt 7.

The intermediate transfer belt 7, which is an endless resin belt, is stretched on a driving roller 10, a secondary transfer counter roller 8, and a tension roller 9, and driven by the driving roller 10. Recording medium P are taken out one by one from a recording medium cassette 11 by a sheet-feeding roller 12, and set on standby at a registration roller 13. The recording medium P is fed to a secondary transfer portion T2 by the registration roller 13, and a toner image is transferred to the recording medium P from the intermediate transfer belt 7 during its process of conveyance through the secondary transfer portion T2. The recording medium P to which the toner image of four colors has been transferred is conveyed to a fixing device 16, and subjected to heating and pressurization at the fixing device 16 to fix the toner image on its surface. The recording medium on which the image has been fixed is discharged through a discharge conveyance path 57 to an external tray 18.

The image forming units PY, PM, PC, and PK are substantially similar in configuration except for different toner colors used at development devices 3Y, 3M, 3C, and 3K, namely, yellow, magenta, cyan, and black. Hereinafter, the image forming unit PY will be described, and repeated description of the image forming units PM, PC, and PK will be omitted.

The image forming unit PY includes a charging roller 2Y, an exposure device 5, a development device 3Y, a transfer roller 6Y, and a drum cleaning device 4Y arranged around a photosensitive drum 1Y. The charging roller 2Y charges a surface of the photosensitive drum 1Y to a uniform potential. The exposure device 5 scans the photosensitive drum 1Y with a laser beam to write an electrostatic image therein. The development device 3Y supplies toner to the electrostatic image to develop a toner image on the photosensitive drum 1Y. A direct current (DC) voltage is applied to the transfer roller 6Y to transfer the toner image of the photosensitive drum 1Y to the intermediate transfer belt 7.

A first exemplary embodiment will be described.

(2) Example of Image Heating Device

Figure 2A:
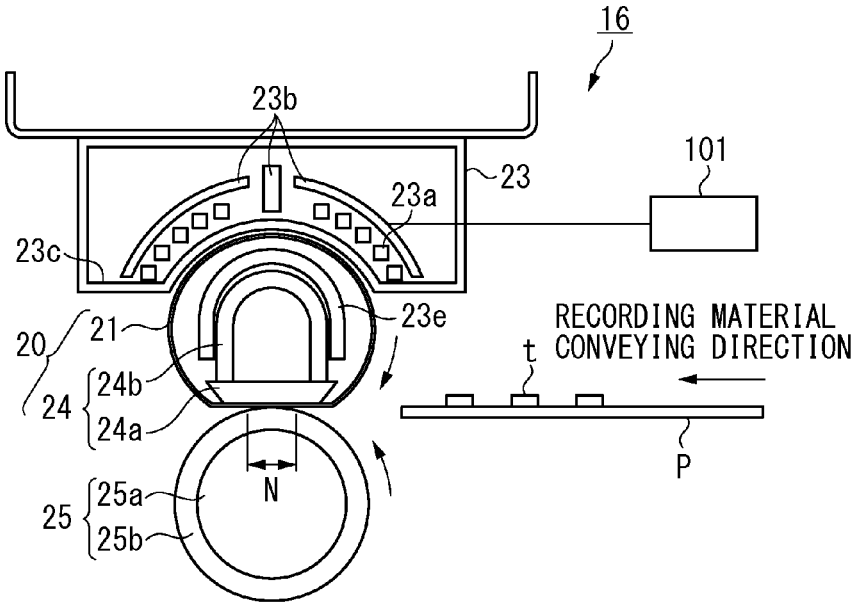
FIGS. 2A and 2B are explanatory views each illustrating a sectional configuration of a fixing device.
Figure 2B:
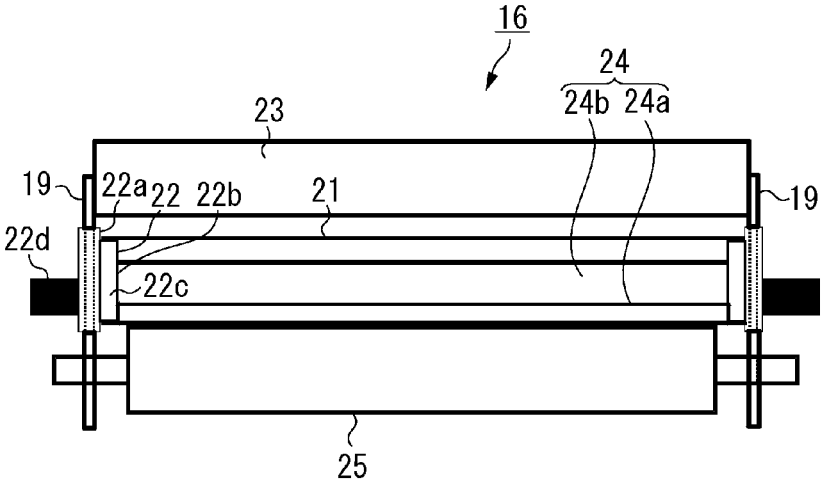
Figure 3:
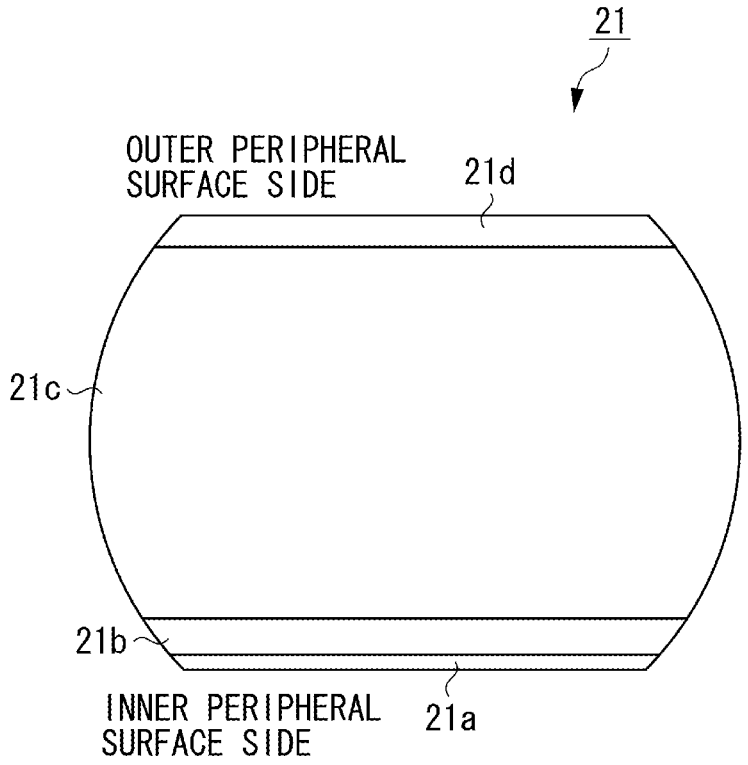
FIG. 3 is an explanatory view illustrating a sectional structure of a fixing belt.
Figure 4:
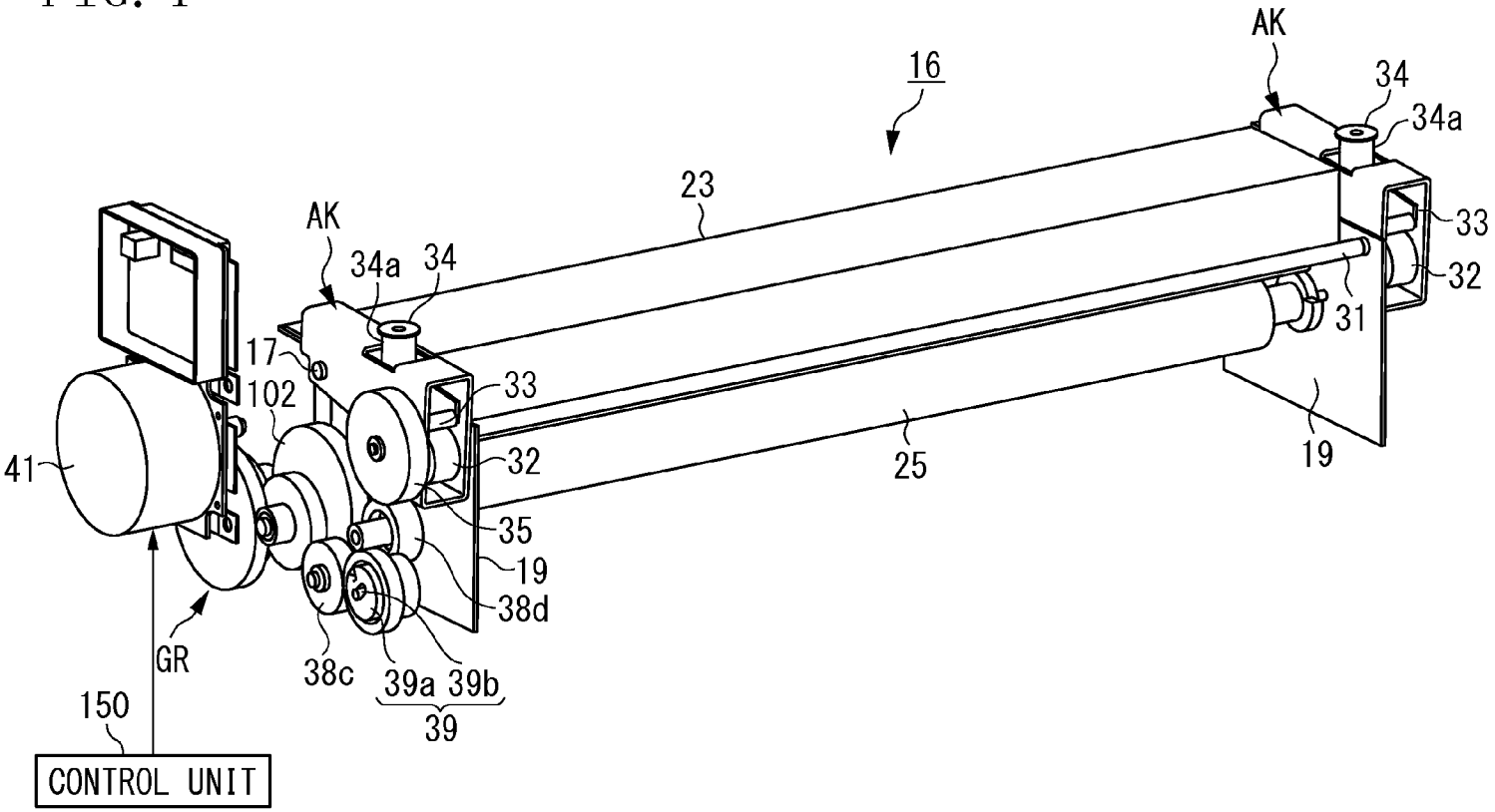
FIG. 4 is a perspective view illustrating the fixing device.

FIGS. 2A and 2B are diagrams each illustrating a sectional configuration of a fixing device. FIG. 3 is a diagram illustrating a sectional structure of a fixing belt. FIG. 4 is a perspective view illustrating the fixing device. Hereinafter, a longitudinal direction concerning the fixing device and members included in the fixing device, is a direction orthogonal to a recording medium conveying direction. A widthwise direction is a direction parallel to the recording medium conveying direction with respect to the surface of the recording medium.

As illustrated in FIG. 2A, the fixing device 16 employs an on-demand method where heat transfer efficiency is high and device starting is fast to heat the recording medium via the fixing belt of a small heat capacity. The fixing device 16 is a belt type fixing device of an electromagnetic induction heating method, which uses a combination of a fixing belt 21 of an electromagnetic induction heating element and an induction heating unit 23 as a heating source of a nip portion N. The fixing device 16 causes the fixing belt 21 adjusted to a predetermined temperature to come into contact with the recording medium pinched and conveyed at the nip portion N to apply heat, and heats and fixes, on a surface of the recording medium, an unfixed toner image borne on the surface of the recording medium. The fixing belt 21 is a flexible cylindrical member.

As illustrated in FIG. 3, the fixing belt 21 is a composite layer film that includes, sequentially from an inner peripheral surface side to an outer peripheral surface side of the fixing belt 21, an inner layer 21*a*, a conductive layer (electromagnetic induction heating element) 21*b*, an elastic layer 21*c*, and a surface release layer 21*d*.

The conductive layer 21*b* is a layer that is induced to generate heat by an electromagnetic induction effect of a magnetic field (magnetic flux) generated by the induction heating unit 23. As the conductive layer 21*b*, a flexible cylindrical metal layer (hereinafter, referred to as metal layer) formed with a thickness of 1 to 50 μm by using a metallic material such as iron, cobalt, nickel, copper, or chromium is used. The elastic layer 21*c* is disposed on an outer peripheral surface of the conductive layer 21*b* by using a predetermined material suitable for the elastic layer of the fixing belt 21.

The surface release layer 21*d* is a layer directly in contact with an unfixed toner image t borne on a sheet P, and thus a material having good releasability must be used. As a material of the surface release layer 21*d*, for example, a tetrafluoroethylene perfluoroalkyl vinyl ether polymer (PFA), polytetrafluoroethylene (PTEF), a silicon copolymer, or a composite layer thereof may be used. The surface release layer 21*d* is formed on an outer peripheral surface of the elastic layer 21*c* with a thickness of 1 to 50 μm by appropriately selecting one of these materials. When the surface release layer 21*d* is too thin, durability in abrasion resistance is low, consequently shortening an endurance life of the fixing belt 21. Conversely, when the surface release layer 21*d* is too thick, it is not desirable because the heat capacity of the fixing belt 21 is increased, consequently prolonging warming-up. In the first exemplary embodiment, in view of balance between the abrasion resistance and the heat capacity of the elastic layer 21*c* , a PFA having a thickness of 30 μm is used for the surface release layer 21*d* of the fixing belt 21.

As illustrated in FIG. 2A, the induction heating unit 23 subjects the fixing belt 12 to electromagnetic induction heating from the outside as a magnetic field generation unit. The induction heating unit 23 is installed outside the fixing belt 21 by maintaining a predetermined gap with an outer peripheral surface (face) of the fixing belt 21. A holder 23*c* of the induction heating unit 23 holds a coil 23*a* and a core 23*b*.

The holder 23*c* is a box-shaped member long in the longitudinal direction of the fixing belt 21 having both ends held by a fixing flange 22. A lower surface side of the holder 23*c* is formed into a dome shape to be along the surface of the fixing belt 21, and faces the surface of the fixing belt 21 with a predetermined gap.

The coil 23*a* is formed into a domed elliptic shape long in the longitudinal direction of the fixing belt 21. The coil 23*a* is disposed in the holder 23*c* to be along the surface of the fixing belt 21. For the coil 23*a* , a litz wire prepared by bundling about 80 to 160 thin insulating coating electric wires of ϕ0.1 to 0.3 mm is used. The litz wire is wound around the core 23*b* 8 to 12 times to constitute the coil 23*a*. The coil 23*a* receives alternating current (AC) from an excitation circuit 101 to generate an AC magnetic flux. The excitation circuit 101 supplies the AC to the coil 24*a* according to a print signal.

The core 23*b* is formed by using a ferromagnetic material, for example, a material such as ferrite high in magnetic permeability and low in residual magnetic flux density, and disposed to surround a winding center of the coil 23*a* and the surroundings of the coil 23*a*. The core 23*b* efficiently guides the AC magnetic flux generated by the coil 23*a* to the conductive layer 21*b* of the fixing belt 21. The core 23*b* is used for increasing efficiency of a magnetic circuit formed by the coil 23*a* and the conductive layer 21*b* of the fixing belt 21 illustrated in FIG. 3 and for magnetic screening.

The core 23*e* is formed by using a ferromagnetic material, and disposed inside the fixing belt 21, which is an opposite side of the core 23*b* with respect to the fixing belt 21. The core 23*e* is disposed between a stay 24*b* and the inner peripheral surface (inner surface) of the fixing belt 21, and constitutes a part of the magnetic circuit of the AC magnetic flux generated by the coil 23*a* to efficiently causes the AC magnetic flux to be incident on the conductive layer 21*b* of the fixing belt 21.

The induction heating unit 23 generates an AC magnetic field to cause the AC magnetic field to be incident on the fixing belt 21. The AC magnetic field generates eddy current on the metal layer of the fixing belt 21, and the eddy current generates Joule heat on the metal layer of the fixing belt 21. When the excitation circuit 101 supplies AC current to the coil 23*a* of the induction heating unit 23, the coil 23*a* generates an AC magnetic field. The AC magnetic field is guided to the core 23*b* to generate eddy current on the fixing belt 21. The eddy current generates Joule heat according to specific resistance of the fixing belt 21. In other words, by supplying the AC current to the coil 23*a*, the fixing belt 21 enters in an electromagnetic induction heat generation state. A temperature of the fixing belt 21 is detected by a temperature detection unit (not illustrated) such as a thermistor. An output signal (temperature detection signal of fixing belt 21) from the thermistor is captured by a power source control circuit (not illustrated). The power source control circuit performs control to turn ON/OFF the excitation circuit 101 based on the output signal so that the temperature of the fixing belt 21 can maintain a predetermined fixing temperature (target temperature).

A pressure roller 25 is an elastic pressure roller having heat resistance as a press contact rotation member. The pressure roller 25 includes a round shank core metal 25*a* and an elastic layer 25*b* disposed in a roller shape on an outer peripheral surface of the core metal 25*a* as illustrated in FIG. 2A. As a material of the elastic layer 25*b*, heat-resistant rubber such as silicon rubber or fluorine-contained rubber, or silicon rubber foam is used. The pressure roller 25 is disposed parallel to the fixing belt 21 on an opposite side of the induction heating unit 23. Longitudinal both ends of the core metal 25*a* are rotatably held on a lower side plate 19 of a fixing device frame via a bearing.

The press contact member 24*a* and the stay 24*b* constitute a pressurization assist member 24 of the fixing belt 21. The press contact member 24*a* is a heat resistant member disposed inside the fixing belt 21. The press contact member 24*a* is a flat-plate member in contact with the inner peripheral surface (inner surface) of the fixing belt 21 on the opposite side of the induction heating unit 23 and disposed to perpendicularly intersect a recording medium conveying direction. Between the press contact member 24*a* and the inner surface of the fixing belt 21, a lubricant such as grease is provided to reduce a frictional force. The stay 24*b* is a member formed into a reverse U shape in a cross section on the press contact member 24*a*, and disposed in a widthwise-direction center of the press contact member 24*a*.

As illustrated in FIG. 2B, the fixing flange 22 is a holding member of the fixing belt 21. A pair of fixing flanges 22 are arranged at longitudinal-direction both ends of the fixing belt, and held by the side plate 19 of the fixing device frame. A fitting recess portion 22*b* is disposed at an end surface of the fixing flange 22. The fixing flange 22 holds the pressurization assist member 24 by engaging the longitudinal-direction end of the pressurization assist member 24 with the fitting recess portion 22*b*.

A belt holding portion 22*c* of the fixing flange 22 is loosely interiorly fitted inside the longitudinal-direction end of the fixing belt 21 to rotatably hold the fixing belt 21. The belt holding portion 22*c* supports the fixing belt 21 from the inside at longitudinal direction both ends of the fixing belt 21 to guide a cylindrical shape of the fixing belt 21. A wall surface 22*a* faces the longitudinal direction end surface of the fixing belt 21. The wall surface 22*a* is a regulating surface to regulate movement of the fixing belt 21 by coming into contact with the longitudinal direction end surface of the fixing belt 21 when the fixing belt 21 moves in the longitudinal direction.

A pressurized portion 22*d* of the fixing flange 22 is pressurized by a pressure lever 33 illustrated in FIG. 5 and described below. A pressurizing force of the pressure lever 33 is applied to the press contact member 24*a* via the stay 24*b*. The press contact member 24*a* that has received the pressurizing force of the pressure lever 33 presses the surface of the fixing belt 21 to a surface of the pressure roller 25. Accordingly, the fixing belt 21 is deformed in conformity to a surface shape of the press contact member 24*a*, and the elastic layer 25*b* of the pressure roller 25 is also elastically deformed in conformity to a surface shape of a sliding portion of the press contact member 24*a*. As a result, a nip portion N having a predetermined width is formed between the surface of the fixing belt 21 and the surface of the pressure roller 25.

As illustrated in FIG. 4, the fixing device 16 is configured such that when a fixing motor 41 as a driving source rotates in a forward direction, a pressure roller driving gear 102 disposed at the longitudinal direction end of the pressure roller 25 rotates in a predetermined direction. Thus, as illustrated in FIG. 2A, the pressure roller 25 rotates in an arrow direction at a predetermined peripheral velocity. The rotation of the pressure roller 25 is transmitted to the surface of the fixing belt 21 by a frictional force between the surface of the pressure roller 25 and the surface of the fixing belt 21 at the nip portion N. The fixing belt 21 rotates following the rotation of the pressure roller 25 while the inner surface of the fixing belt 21 slides to the press contact member 24*a*.

As illustrated in FIG. 2A, in a state where the pressure roller 25 and the fixing belt 21 rotate and the temperature of the fixing belt 21 is maintained at a predetermined fixing temperature, the recording medium P on which the unfixed toner image t is borne is introduced to the nip portion N. The recording medium P is pinched and conveyed between the surface of the fixing belt 21 and the surface of the pressure roller 25 at the nip portion N. Then, the toner image t receives heat of the fixing belt 21 and pressure of the nip portion N during the conveyance process to be heated and fixed on the recording medium P. The recording medium P out of the nip portion P is separated from the surface of the fixing belt 21 to be discharged from the nip portion N.

(3) Pressurization/Pressurization Releasing Mechanism

Figure 5:
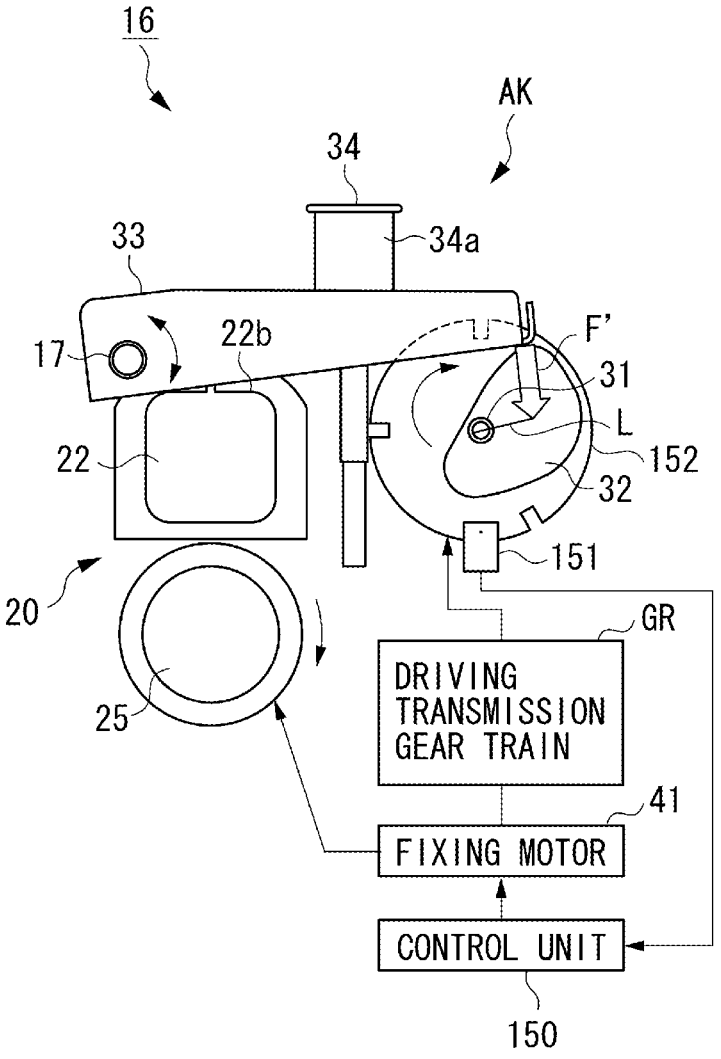
FIG. 5 is an explanatory view illustrating a pressurization/pressurization releasing mechanism.
Figure 6A:
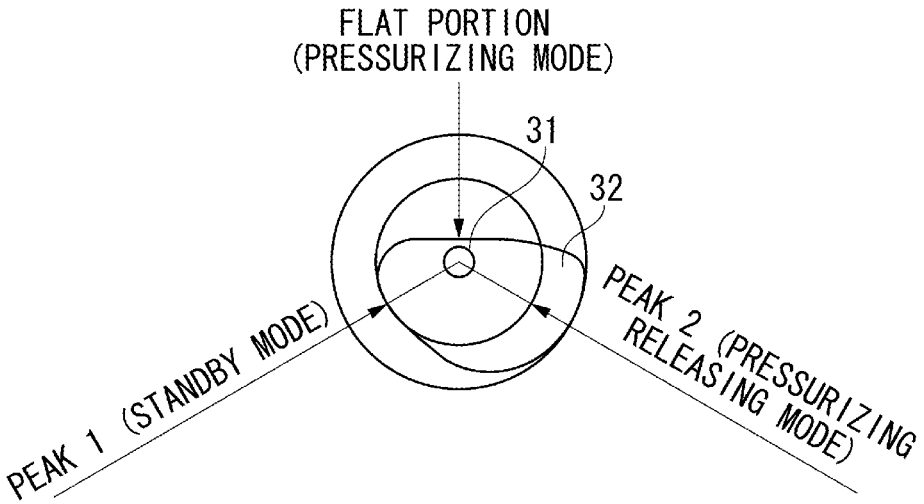
FIGS. 6A and 6B are explanatory views each illustrating a cam curve of an eccentric cam.
Figure 6B:
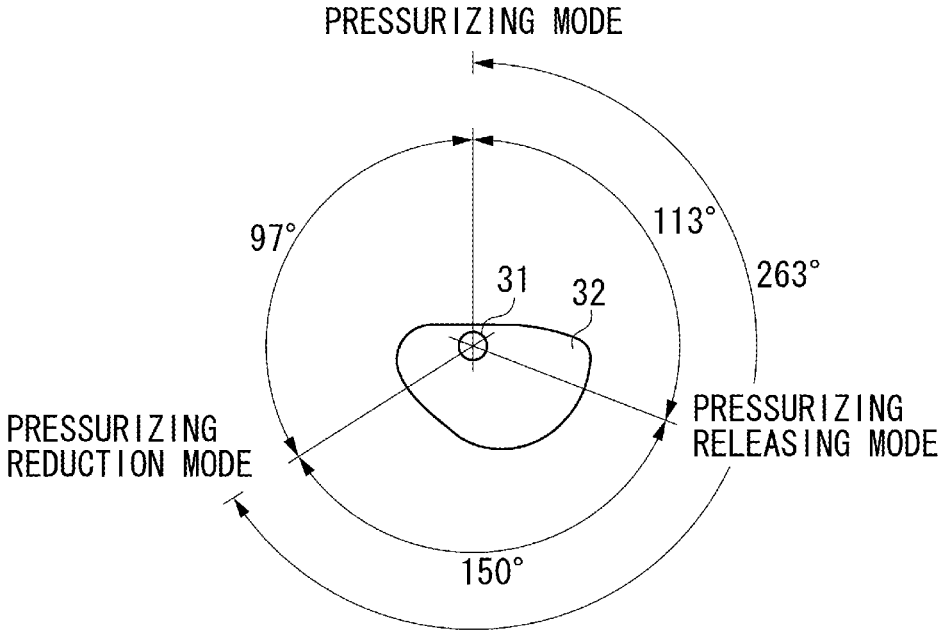
Figures 7A, 7B, 7C:
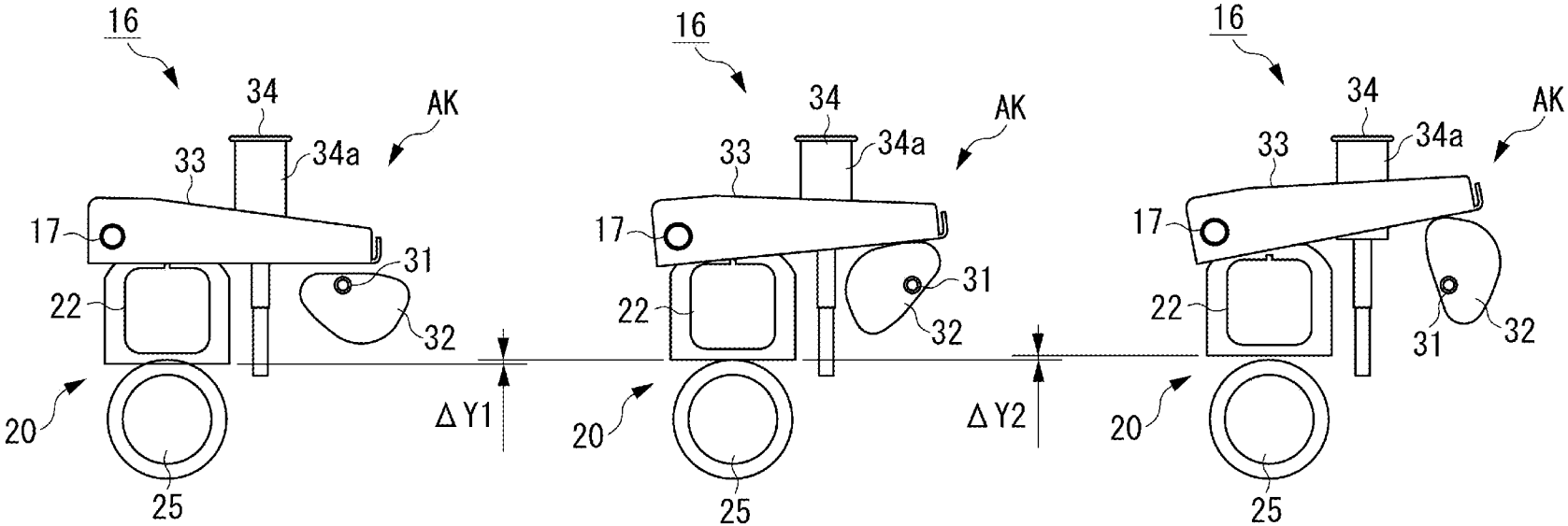
FIGS. 7A to 7C are explanatory views each illustrating a rotational position of the eccentric cam in each mode.

FIG. 5 is a diagram illustrating a pressurization/pressurization releasing mechanism. FIGS. 6A and 6B are diagrams each illustrating a cam curve of the eccentric cam. FIGS. 7A to 7C are diagrams each illustrating a rotational position of the eccentric cam in each mode.

As illustrated in FIGS. 2A and 2B, the fixing belt 21 as an example of a heating rotation member heats an image surface of the recording medium. The pressure roller 25 as an example of the press contact rotation member is pressed into contact with the fixing belt 21 to form a nip portion N of the recording medium.

As illustrated in FIG. 4, the pressure lever 33 as an example of a pressurization unit urges the fixing belt 21 or the pressure roller 25 to apply pressure on the nip portion. The fixing motor 41 as an example of the motor is a DC brushless motor that increases a rotational speed of a rotor after start up toward a rotational speed of the rotational magnetic field of the stator. The fixing motor 41 drives at least one of the fixing belt 21 and the pressure roller 25 to rotate. A gear 39 as an example of a one-way clutch transmits rotational driving of one direction from the fixing motor 41 to rotate the eccentric cam 32, and idly runs rotational driving of the other direction from the fixing motor 41 to maintain the eccentric cam 32 in a stopped state. The eccentric cam 32 as an example of a cam member is driven by the fixing motor 41 to rotate, and receives pressure from the pressure lever 33 in a burden-sharing manner according to the rotational position to change the pressurizing force of the nip portion.

The fixing device 16 operates the fixing motor 41 in an opposite direction to that during the fixing processing, thereby operating the pressurization/pressurization releasing mechanism AK to change the press contact force of the fixing belt unit 20 to the pressure roller 25 at three stages. The pressurization/pressurization releasing mechanism AK drives a rotary drive shaft 31 to rotate the eccentric cam 32, thereby inclining the pressure lever 33 against a urging force of a screw 34 with a spring.

The rotary drive shaft 31 has its longitudinal direction both ends rotatably held on the side plate 19 of the device frame. Eccentric cams 32 are arranged at longitudinal direction both ends of the rotary drive shaft 31. A pressure releasing gear 35 is disposed at a longitudinal direction on one side end of the rotary drive shaft 31. The pressure lever 33 is rotatably held by a support shaft 17 having longitudinal direction with each end disposed on the side plate 19 of the device frame.

As illustrated in FIG. 5, the pressure lever 33 is pressed to the fixing flange 22 side by a pressure spring 34*a* of the screw 34 with the spring disposed at the end opposite the support shaft 17. The pressure lever 33 can move in a direction for coming into press contact with the pressurized portion 22*d* of the fixing flange 22 with the support shaft 17 set as a fulcrum, or a direction away from the pressurized portion 22*d* of the fixing flange 22.

A control unit 150 activates the fixing motor 41 according to a predetermined signal obtained by detecting a sensor flag 152 by a photo interrupter 151. After the fixing motor 41 has been activated, the pressure releasing gear 35 rotates by a predetermined amount in a predetermined direction via a driving transfer gear train GR. The rotary drive shaft 31 rotates in response to the rotation of the pressure releasing gear 35, accompanied by rotation of the eccentric cam 32.

As illustrated in FIG. 6A, the eccentric cam 32 has one flat portion and two peak shapes. The one flat portion corresponds to the pressurization mode executed during the fixing processing, and the two peak shapes respectively correspond to the standby mode executed during the image formation standing-by period and the pressurization releasing mode during the stop period.

As illustrated in FIG. 7A, when the lowest (near center) flat portion of the eccentric cam 32 faces the pressure lever 33, a pressurizing force applied by the pressure lever 33 urged by the pressure spring 34*a* of the screw 34 with the spring to the fixing flange 22 is largest.

As illustrated in FIG. 7B, when the eccentric cam 32 rotates to push up the pressure lever 33 to a first peak position, the pressurizing force to the fixing flange 22 is halved, and a position of the fixing belt unit 20 is raised by ΔY1.

As illustrated in FIG. 7C, when the eccentric cam 32 pushes up the pressure lever 33 to a highest second peak position, the fixing belt unit 20 is further raised by ΔY2 to invalidate the pressurizing force to the fixing flange 22, thereby separating the fixing belt 21 and the pressure roller 25 from each other.

(4) Gear 39

Figure 8A:
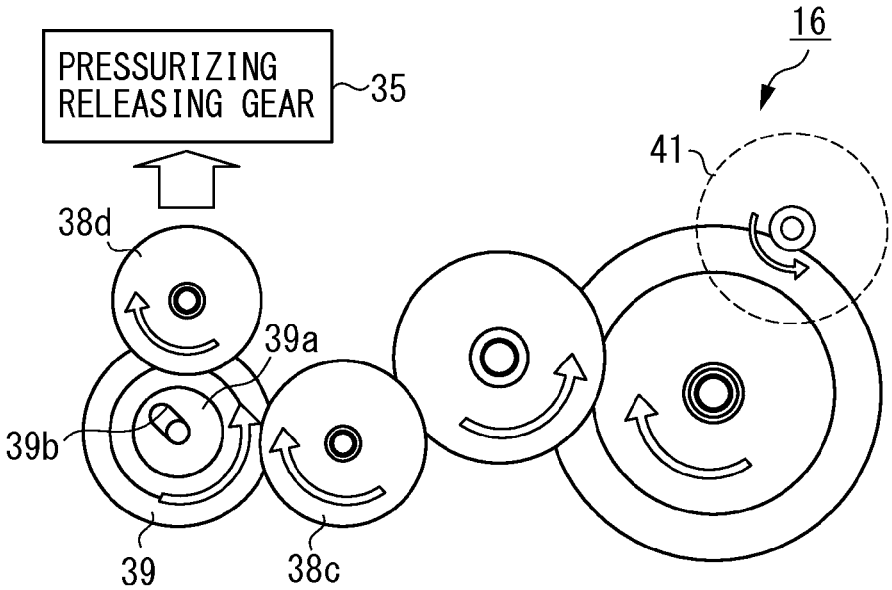
FIGS. 8A and 8B are explanatory views each illustrating an operation of a one-way clutch.
Figure 8B:
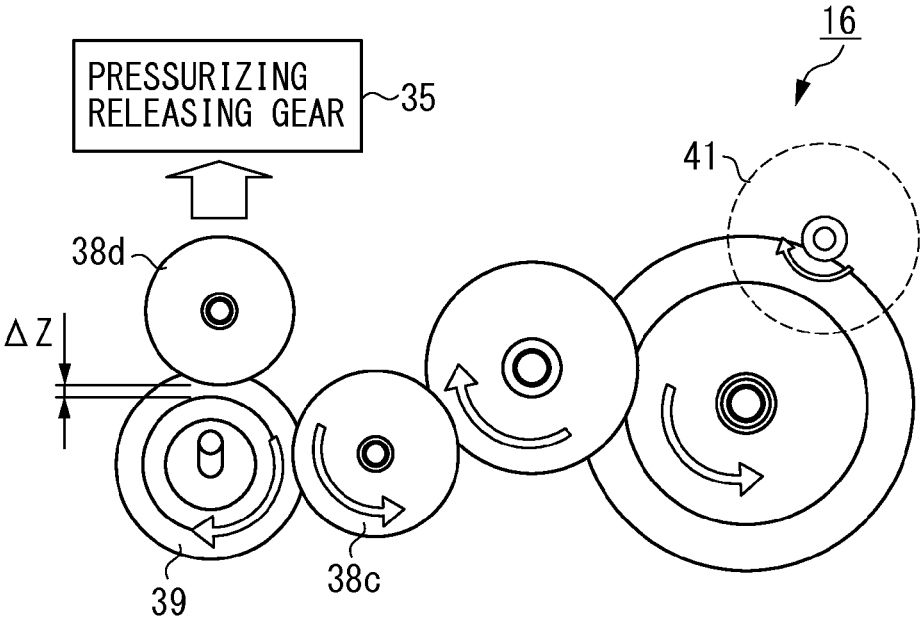
Figure 9A:
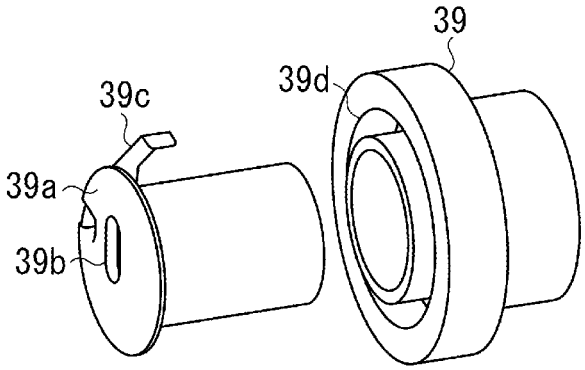
FIGS. 9A and 9B are perspective views each illustrating gear 39.
Figure 9B:
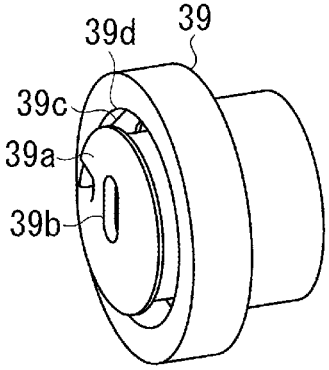
Figure 10A:
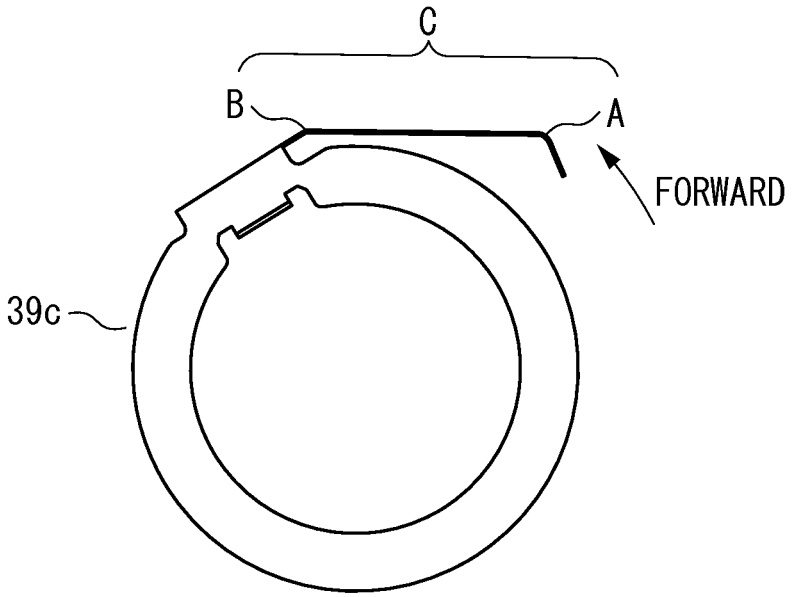
FIGS. 10A and 10B are diagrams each illustrating a friction structure of the gear 39.
Figure 10B:
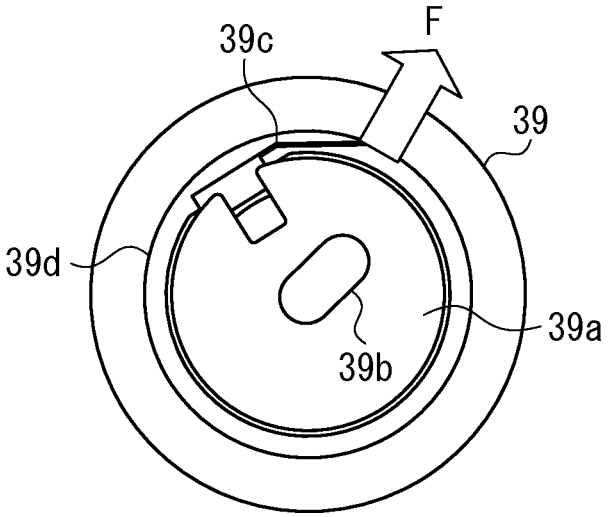

FIGS. 8A and 8B are diagrams each illustrating an operation of the one-way clutch. FIGS. 9A and 9B are perspective views each illustrating the gear 39. FIGS. 10A and 10B are diagrams each illustrating a friction structure of the gear 39.

As illustrated in FIG. 4, the conveyance of the recording medium during the fixing processing at the fixing device 16 is performed by rotating the fixing motor 41 in a forward direction. On the other hand, the changing of the pressurizing force between the modes is performed by rotating the fixing motor 41 in a backward direction. The one-way clutch is disposed in the driving transfer gear train GR to prevent separation of the fixing belt unit 20 from the pressure roller 25 caused by transmission of driving of the fixing motor 41 to the eccentric cam 32 during the fixing processing as illustrated in FIG. 7C.

As illustrated in FIG. 8A, the one-way clutch includes an gear 39 oscillated by a tangential force of an idler gear 38*c*. The gear 39 is rotatably supported around an assist member 39*a*. Since a elongated hole 39*b* is formed in the assist member 39*a*, the gear 39 is movable by an amount equal to a length of the elongated hole 39*b*. The assist member 39*a* oscillates by 45° according to a rotational direction of the oscillating gear 39 to switch the oscillating gear 39 between an engaged state and a separated state.

As illustrated in FIG. 8A, while the fixing motor 41 rotates in the backward direction, the gear 39 is lifted by the tangential force of the idler gear 38*c* to move in a direction to be engaged with the idler gear 38*d*, thereby transmitting driving of the fixing motor 41 to the eccentric cam 32.

As illustrated in FIG. 8B, while the fixing motor 41 rotates in the forward direction, the gear 39 oscillates in a direction away by a distance AZ from the idler gear 38*d* following reverse rotation of the idler gear 38*c*, and cuts off the driving transmission of the fixing motor 41 to maintain the eccentric cam 32 in a stopped state.

As illustrated in FIG. 9A, the urging member 39*c* is held by the assist member 39*a* by fitting engagement. The urging member 39*c* is disposed in a groove 39*d* formed in an inner surface of the gear 39. The urging member 39*c* forms rotational resistance of the gear 39 by friction with an outer side surface of the groove 39*d* of the gear 39. The rotational resistance by the friction of the urging member 39*c* rotates the assist member 39*a* as illustrated in FIG. 8A to switch a moving direction of the gear 39. The rotational resistance of the oscillating gear 39 by the friction of the urging member 39*c* generates, in the engagement with the idler gear 38*d*, a pressurizing force (tangential force) of a gear surface enough to move the gear 39 along the elongated hole 39*b*.

As illustrated in FIG. 10A, the urging member 39*c* is a leaf spring, an arm C bends around B, and a press contact portion A comes into press contact with the groove 39*d* formed in the gear 39. As illustrated in FIG. 10B, the urging member 39*c* is brought into press contact with the groove 39*d* formed in the gear 39 by a force F to increase rotational torque of the gear 39. By increasing the tangential force of the idler gear 38*c*, an moving operation of the gear 39 is made smooth.

(5) Pressurization Reducing Mode (Standby Mode)

Figure 11A:
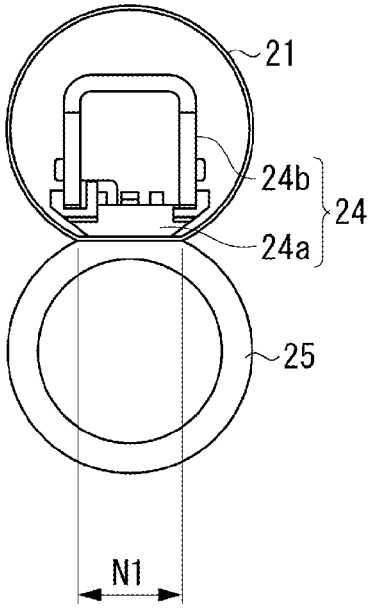
FIGS. 11A and 11B are explanatory views each illustrating a pressurization reducing mode.
Figure 11B:
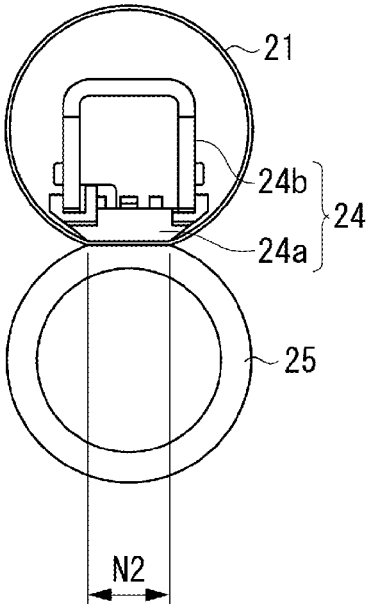

FIGS. 11A and 11B are diagrams each illustrating a pressurization reducing mode. As illustrated in FIG. 7C, the pressurization releasing mode has two purposes. One is to enable a user to easily perform paper jamming processing when recording medium jamming occurs in the fixing device 16. The other is to prevent deformation of the elastic layer of the pressure roller 25 due to causing the fixing belt unit 20 to come into press contact with the pressure roller 25 for a long time as illustrated in FIG. 2A. Thus, the pressurization releasing mode is performed when paper jamming occurs, an error is generated, or power is turned OFF.

When a copying operation ends, and the processing shifts to the pressurization releasing mode to stop heating of the fixing belt 21, the temperatures of the fixing belt 21 and the pressure roller 25 decrease. In particular, the temperature of the fixing belt 21 having a low heat capacity rapidly drops. This necessitates heating of the fixing belt 21 to a predetermined temperature again before a next copying operation is performed, and the user must wait during this heating time. In the fixing device 16, up to 30 seconds of heating time is necessary.

To shorten time until the start of the next copying operation, the fixing belt 21 must be maintained at a high temperature. However, as illustrated in FIG. 11A, when the fixing belt 21 is heated in a normal pressurization mode, heat of the fixing belt 21 is captured by the pressure roller 25 via the nip portion N to waste power.

Accordingly, as illustrated in FIG. 11B, in the fixing device 16, in place of the pressurization releasing mode, the pressurization reducing mode (standby mode) is executed, and a halved state of a pressurizing force applied to the fixing flange 22 is maintained until the next copying operation. When the pressurizing force is halved, the nip portion N formed between the fixing belt 21 and the pressure roller 25 is narrowed, and thus the heat of the fixing belt 21 is difficult to be captured by the pressure roller 25. By standing by for a time until next fixing processing in the standby mode, power can be saved, and recovery time can be shortened.

In the standby mode, the induction heating unit 23 is controlled to prevent the temperature of the fixing belt 21 from becoming equal to or lower than a fixed temperature. By maintaining the temperature of the fixing belt 21, warming-up time when printing is started from the waiting state is shortened.

In the standby mode, rotational speeds of the pressure roller 25 and the fixing belt 21 are lowered to 50 mm/sec lower than a rotational speed 200 mm/sec during the fixing processing. By reducing the rotational speeds, a slide frictional sliding frequency between the fixing belt 21 and the pressure roller 25 is reduced, and lives of the fixing belt 21 and the pressure roller 25 are prolonged.

In the standby mode, to minimize heat shifted from the fixing belt 21 to the pressure roller 25, a pressurizing force in the standby mode must be minimized. However, to continue rotation of the fixing belt 21 that is rotatably driven by abutting on the pressure roller 25, a certain pressurizing force is necessary.

The following expression (1) is established.

$$F=\mu 1\cdot P \tag{1}$$

Where μ1 is a friction coefficient between the press contact member 24*a* and the fixing belt 21, F is a frictional force when the fixing belt 21 rotates as illustrated in FIG. 2A, and P is a pressurizing force.

When as a material of the elastic layer 25*b* of the pressure roller 25, heat-resistant rubber such as silicon rubber or fluorine-contained rubber, or silicon rubber foam is used, an adhesive frictional force and an energy loss frictional force are generated between a rigid member (fixing belt 21) and the rubber. A frictional force Fr is a force by which the pressure roller 25 rotates the fixing belt 21. The frictional force Fr between the fixing belt 21 and the pressure roller 25 is represented by the following expression (2).

$$Fr=Fadh+Fhys \tag{2}$$

Where Fadh is an adhesive frictional force, and Fhys is an energy loss frictional force.

The energy loss frictional force Fhys can be ignored as long as a rubber deformation amount and a speed are not considerably large and high. The adhesive frictional force Fadh is proportional to a contact area, and increased in proportion to a real contact area A between the rubber and the rigid member. Thus, the following expression is established.

$$Fadh=K1\cdot A \tag{3}$$

Where K1 corresponds to an adhesive frictional force per real unit contact area, and depends on a material of a contact article. In other words, K1 indicates a shearing destructive force of molecular-level coupling of the rubber and the rigid member (fixing belt 21).

However, since the rubber is an elastic member, the real contact area exhibits a nonlinear change, establishing a relationship of the following expression.

$$A=K2P^{n}(n=1 \text{ to } 2/3) \tag{4}$$

Where K2 is a constant indicating deformation easiness, and n is a constant determined by a material or a shape. Thus, the following relationship is established by the expressions (2), (3), and (4).

$$\mathrm{Fr}=\mathrm{Fadh}=K1\cdot K2P^{n} \tag{5}$$

The frictional force Fr depends on the real contact area A as described above. The contact area A concerns a vertical load P, a shape of the contact article, and deformation easiness of the contact article. A relationship of Fr>F must be set to rotate the fixing belt 21. In other words, a relationship of the following expression must be established.

$$K1\cdot K2Pn>\mu 1\cdot P \tag{6}$$

To reorganize this relational expression for P, a relationship of the following expression is established.

$$P>(\mu 1/K1\cdot K2))^{1/(n-1)} \tag{7}$$

Accordingly, the fixing belt is rotated by a smallest force with a pressurizing force $P=(\mu 1/(K1\cdot K2))^{1/(n-1)}$. Heat capturing by the pressure roller is most difficult, and power in the standby can be suppressed.

(6) Problem in Shifting from Pressurization Releasing Mode to Pressurizing Mode

Figure 12:
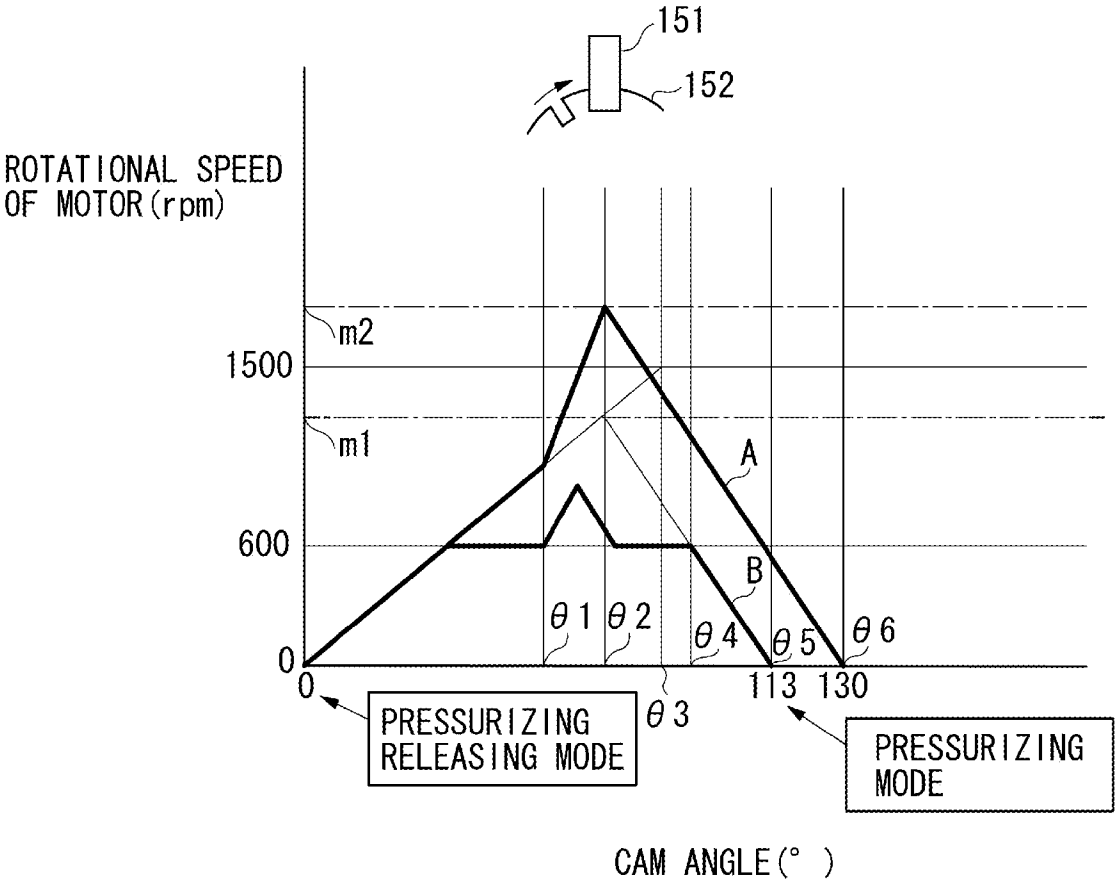
FIG. 12 is a diagram illustrating a relationship between a set rotational speed of a fixing motor and a stop position of the eccentric cam.

FIG. 12 is a diagram illustrating a relationship between a set rotational speed of the fixing motor and a stop position of the eccentric cam.

As illustrated in FIG. 7C, in the case of shifting from the pressurization releasing mode to the pressurizing mode, the eccentric cam 32 rotates by 113° in the arrow direction as illustrated in FIG. 6B. On the other hand, in the case of shifting from the pressurization reducing mode to the pressurizing mode, the eccentric cam 32 rotates by 263° in the arrow direction as illustrated in FIG. 6B.

It has been turned out that when the fixing motor 41 is controlled by a timer to be operated for only a period of time according to a necessary rotational angle, during shifting from the pressurization releasing mode to the pressurizing mode, the eccentric cam 32 rotates by 113° or more, thus causing a rotational stop position to be unstable. On the other hand, it has been turned out that during shifting from the pressurization reducing mode to the pressurizing mode, the eccentric cam 32 can be stopped in an almost 263-degree rotated state.

As illustrated in FIG. 5, smooth rotation of a fixed speed is required of the fixing motor 41 during the fixing processing of the recording medium, and the brushless motor is employed because the smooth rotation of the fixed rotational speed can be achieved at low cost. However, when the brushless motor is operated for a given period of time by setting a rotational magnetic field of the stator to a predetermined rotational speed and then stopped, a rotational distance is longer if a load is reduced at rising of the rotational speed.

As illustrated in FIG. 12, rotational stop positions of the eccentric cam 32 are compared between a case where the rotational speed of the rotational magnetic field of the stator of the fixing motor 41 is set to 1500 rpm and a case where it is set to 600 rpm. After a rotational magnetic field of a predetermined rotational speed is generated in the stator of the fixing motor 41, the control unit 150 stops the rotational magnetic field of the stator at timing of detecting by the photo interrupter 151 a slit of the sensor flag 152 disposed coaxially to the eccentric cam 32. In the slit of the sensor flag 152, each stop position illustrated in FIG. 6B is set to an angle position determined in view of a braking distance before reaching the pressure lever 33.

FIG. 12 illustrates an angle θ1 where the eccentric cam 32 is pushed by the pressure lever 33 to increase the rotational speed of the fixing motor 41, an angle θ2 where motor stopping control is performed when the rotational speed of the fixing motor 41 is set to 1500 rpm, an angle θ3 where the rotational speed of the fixing motor 41 is originally set to 1500 rpm, an angle θ4 where motor stop control is performed when the rotational speed of the fixing motor 41 is set to 600 rpm, an angle θ5 where the eccentric cam 32 is stopped when the rotational speed of the fixing motor 41 is set to 600 rpm, an angle θ6 where the eccentric cam 32 is stopped when the rotational speed of the fixing motor 41 is set to 1500 rpm, a motor rotational speed m1 where motor stop control is performed when the rotational speed of the fixing motor 41 is originally set to 1500 rpm, and a motor rotational speed m2 where the eccentric cam 32 is pushed by the pressure lever 33 to increase a speed.

As indicated by a curve A, when the rotational speed of the rotational magnetic field was set to 1500 rpm, and activation/stopping of the fixing motor 41 was controlled from the pressurization releasing mode to the pressurizing mode, the eccentric cam 32 originally scheduled to stop at 113° overran to 130°. Since the eccentric cam 32 receives pressing of the pressure lever 33 to accelerate at the rotational angle θ1 before the rotational speed of the rotor reached 1500 rpm, the rotor rotation speed exceeded 1800 rpm when the photo interrupter 151 detected a slit. Thus, braking time was extended, and a stop position was at 130°. Since a motor stop signal was transmitted during the acceleration of the fixing motor 41, the fixing motor 41 was unable to stably stop, and the eccentric cam 32 rotated too much to stop at a predetermined angle. While a shifting angle from the pressurization releasing mode to the pressurizing mode was 113°, when the fixing motor 41 was rotated at 1500 rpm, the eccentric cam 32 rotated by 130°, which was deviation of 17° from the predetermined angle.

As illustrated in FIG. 5, during shifting from the pressurization releasing mode to the pressurizing mode, the eccentric cam 32 is pressed by the pressure lever 33 by a stretching force of the pressure spring 34*a*. At this time, the eccentric cam 32 receives moment M=(F'×L), where F' is a pressing force of the eccentric cam 32 by the pressure lever 33, and L is a distance from a point of contact of the pressure lever 33 with the eccentric cam 32 to a rotational center of the eccentric cam 32. The eccentric cam 32 was rotated by the external force. Thus, control of the fixing motor 41 was not effective, and the fixing motor 41 rotated at a speed equal to or higher than a predetermined speed. When the rotational speed of the fixing motor 41 is high, the apparatus is easily affected by acceleration.

Thus, in the first exemplary embodiment, when activation/stopping of the fixing motor 41 is controlled from the pressurization releasing mode to the pressurizing mode, the rotational speed of the rotational magnetic field is set to 600 rpm to control activation/stopping of the fixing motor 41. Thus, as indicated by a curve B illustrated in FIG. 12, the rotational speed of the rotor was set to predetermined 600 rpm when the photo interrupter 151 detected the slit, and the stop position was controlled to 113° after prescribed braking time.

As indicated by a curve B, when the rotational speed of the motor 412 is set to 600 rpm, the following three advantages are provided.

(A) The rotational speed of the motor 41 is stable when a stop signal enters into the motor 41. Thus, stopping of the motor is stabilized.

(B) The rotational speed of the motor 41 is low. Thus, a rotational speed increase amount caused by pressing of the eccentric cam 32 by the pressure lever 33 is small.

(C) While the eccentric cam 32 is pressed by the pressure lever 33, the rotational speed of the motor 41 is stable, and thus a rotational speed increase amount of the motor 41 is small.

(7) Order of Mode Shifting and Shifting Procedure

Figure 13A:
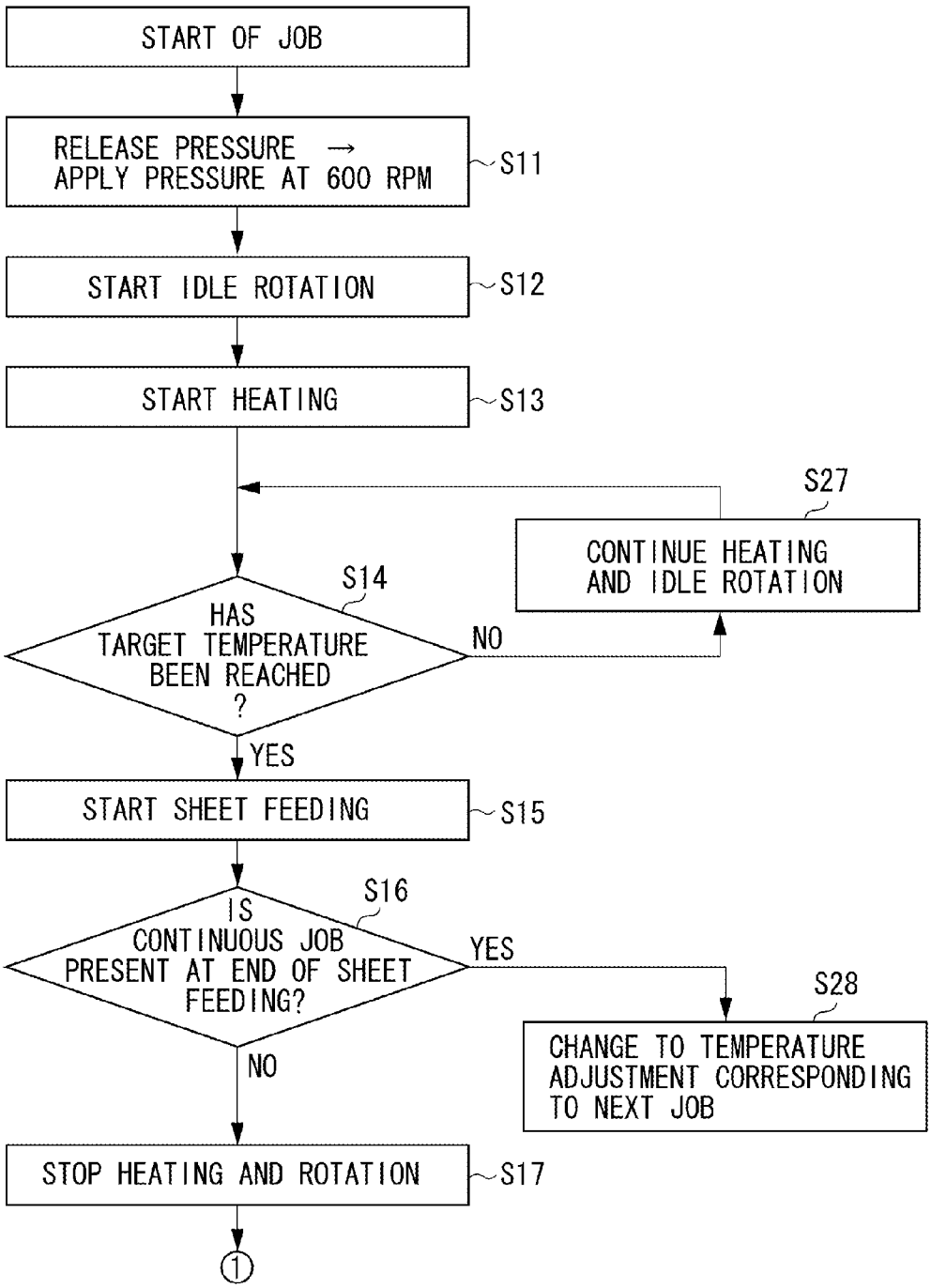
FIG. 13, which is composed of FIG. 13A and FIG. 13B, is a flowchart illustrating each mode shifting control according to a first exemplary embodiment.
Figure 13B:
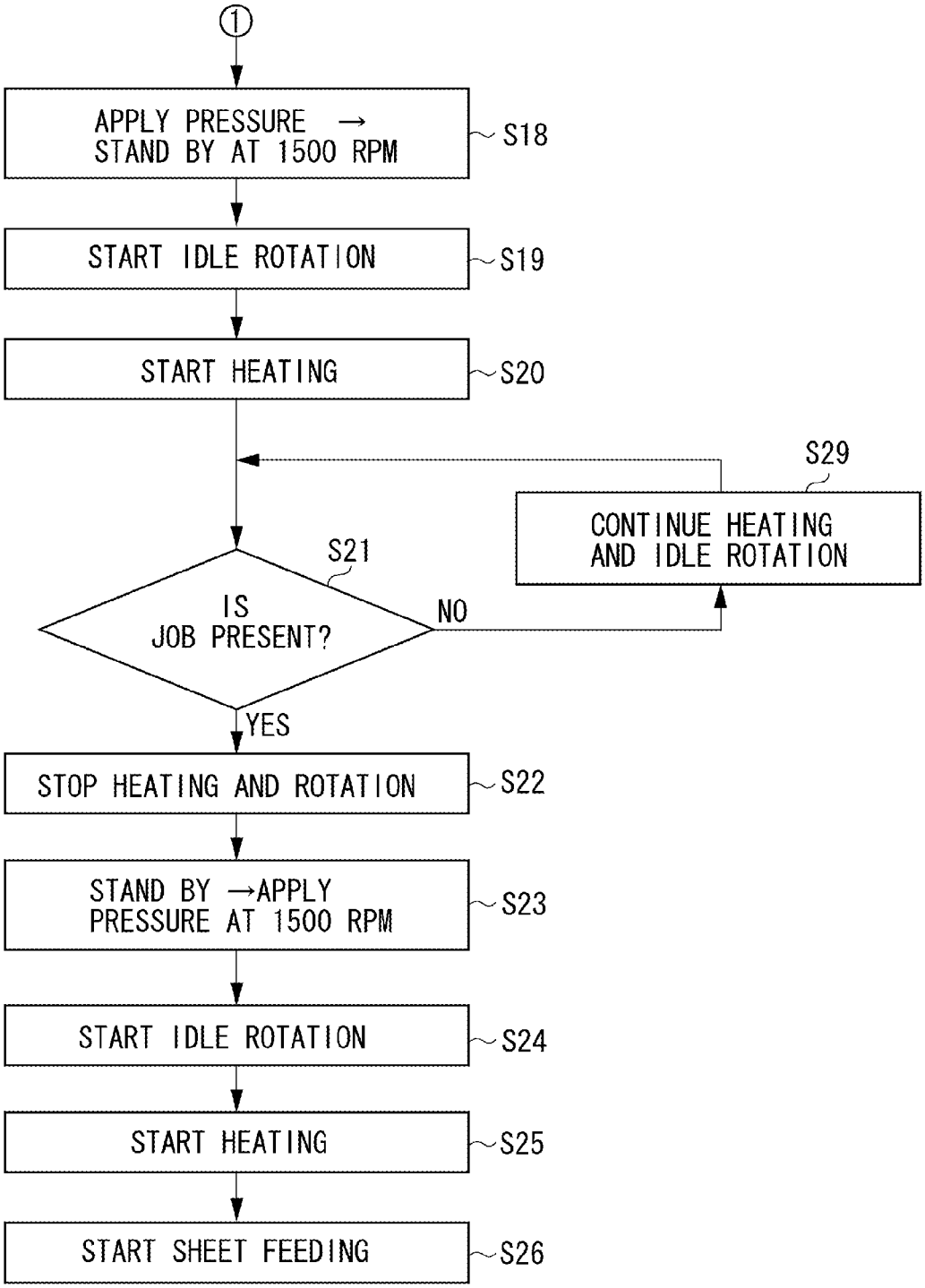

FIG. 13, which is composed of FIG. 13A and FIG. 13B, is a flowchart illustrating each mode shifting control according to the first exemplary embodiment.

As illustrated in FIG. 5, the photo interrupter 151 as an example of a detection unit can detect rotational positions of the eccentric cam 32 corresponding to respective stop periods of the rotational magnetic field of the stator in a first rotational process and a second rotational process. The control unit 150 controls the fixing motor 41, and causes the eccentric cam 32 to perform the first rotational process of 113° to set a pressurizing force of the nip portion to a first predetermined change, and to perform the second rotational process of 263° to set the pressurizing force of the nip portion to a second predetermined change. The control unit 150 stops the rotational magnetic field of the stator based on an output of the photo interrupter 151.

The control unit 150 sets the first rotational process and the second rotational process to different rotational speeds of the rotational magnetic field of the stator so as to prevent the eccentric cam 32 from receiving rotational-direction acceleration from the pressure lever 33 before the rotational speed of the rotor reaches a first rotational speed, and activates the motor. The control unit 150 sets the first rotational process and the second rotational process to different rotational speeds of the rotational magnetic field of the stator so as to prevent the eccentric cam 32 from receiving rotational-direction acceleration from the pressure lever 33 when the rotational magnetic field of the stator decelerates the rotor. The control unit 150 sets the first rotational process and the second rotational process to different rotational speeds of the rotational magnetic field of the stator so that the rotational speed of the rotational magnetic field of the stator is lower as the rotational angle of the eccentric cam 32 from activation to stopping in the rotational process is smaller.

As illustrated in FIGS. 7A to 7C, shifting to the respective modes in the fixing device 16 is repeated by an order of the pressurization mode, the pressurization reducing mode, the pressurization releasing mode, the pressurization mode, . . . . This is because the eccentric cam 32 rotates only in one direction. In the mode shifting procedure, to prevent local heating of the stopped fixing belt 21, rotation of the fixing belt 21 must be stopped after heating of the fixing belt 21 is stopped, and heating of the fixing belt 21 must be started after rotation of the fixing belt 21 is started. To reverse the rotational direction of the fixing motor 41, a pressurizing force must be changed after rotation of the fixing belt 21 is stopped in the pressurization mode, and rotation of the fixing belt 21 must be started after the pressurizing force is changed. The motor for rotating the pressure roller 25 and the fixing belt 21 and the motor for releasing pressure from the fixing belt unit 20 are identical, and thus rotation of the pressure roller 25 must be temporarily stopped when the pressurizing force is changed.

Referring to FIG. 5, as illustrated in FIG. 13, in step S11, the control unit 150 sets a rotational speed (target value) of the fixing motor 41 to 600 rpm to reversely rotate the fixing motor 41, thereby shifting the mode from the pressurization releasing mode to the pressurization mode.

In step S12, the control unit 150 rotates the fixing motor 41 in a forward direction after the mode switching. In step S13, the control unit 150 starts heating of the fixing belt 21. If it is determined that a target temperature has not been reached (NO in step S14), the processing proceeds to step S27 to continue the heating. If it is determined that the temperature of the fixing belt 21 has reached the target temperature (YES in step S14), in step S15, fixing processing is started.

If it is determined that a next image forming job has been received at the end of an image forming job (YES in step S16), the control unit 150 shifts the processing to step S28 of temperature adjustment corresponding to the next image forming job.

If it is determined that a next image forming job has not been received (NO in step S16), in step S17, the control unit 150 stops the rotation and the heating of the fixing belt 21. Then, in step S18, the control unit 150 sets a rotational speed (target value) of the fixing motor 41 to 1500 rpm to reversely rotate the fixing motor 41, thereby shifting the mode from the pressurization mode to the standby mode. In step S19, the control unit 150 rotates the fixing motor 41 in the forward direction after the mode switching. In step S20, the control unit 150 starts heating of the fixing belt 21. When it is determined that a next image forming job has not been received (NO in step S21), in step S29, the control unit 150 continues the standby mode.

If it is determined that a next image forming job has been received (YES in step S21), in step S22, the control unit 150 stops the rotation and the heating of the fixing belt 21. Then, in step S23, the control unit 150 sets a rotational speed (target value) of the fixing motor 41 to 1500 rpm to reversely rotate the fixing motor 41, thereby shifting the mode from the standby mode to the pressurization mode.

In step S24, the control unit 150 rotates the fixing motor 41 in the forward direction after the mode switching. In step S25, the control unit 150 starts heating of the fixing belt 21. If it is determined that the temperature of the fixing belt 21 has reached the target temperature, in step S26, fixing processing is started.

(8) Time Required from Pressurization Releasing Mode to Pressurization Mode

As illustrated in FIG. 6B, a shifting angle from the pressurization releasing mode to the pressurization mode is 113°. As illustrated in FIG. 12, if the rotational speed of the rotational magnetic field of the stator is set to 600 rpm, the pressure releasing gear 35 and the eccentric cam 32 rotate once for 2.71 seconds, and at a speed of 7.53 msec per 1°.

The eccentric cam 32 rotates at the rotational speed of 7.53 msec per 1° at the angle 113° from the pressurization releasing mode to the pressurization mode. Accordingly, time of shifting from the pressurization releasing mode to the pressurization mode is represented by the following expression.

$$7.53/1000\times113\approx0.85 \text{ seconds}$$

(9) Time Required from Standby Mode to Pressurization Mode

As illustrated in FIG. 6B, a shifting angle from the standby mode to the pressurization mode is 263°. As illustrated in FIG. 12, even if the rotational speed of the rotational magnetic field of the stator is set to 1500 rpm to activate the fixing motor 41, the fixing motor 41 stabilizes at 1500 rpm almost at 90°, and then receives acceleration applied by the pressure lever 33. Thus, rotor acceleration is limited. Thus, even if the rotational speed of the rotational magnetic field of the stator is lowered to 0 rpm at timing of detecting a slit by the photo interrupter 151, deceleration is executed in time, and the eccentric cam 32 is stopped without exceeding 263° so greatly. If the rotational speed of the rotational magnetic field of the stator is set to 1500 rpm, the pressure releasing gear 35 and the eccentric cam 32 rotate once for 1.08 seconds, and at a speed of 3.00 msec per 1°. Since the eccentric cam 32 rotates at the rotational speed of 3.00 msec per 1°, time of shifting from the standby mode to the pressurization mode is represented by the following expression.

$$3.00/1000\times263\approx0.79 \text{ seconds}$$

As in the case of shifting from the pressurization releasing mode to the pressurization mode, if the speed is set to 600 rpm, the time of shifting from the standby mode to the pressurization mode is represented by the following expression.

$$7.53/1000\times263\approx1.98 \text{ seconds}$$

If the processing from the motor rotation start to the stop during the shifting from the standby mode to the pressurization mode cannot be completed within 1.4 seconds, recovery time of 30 seconds up to image formation including necessary temperature adjustment cannot be achieved. By setting the speed from the standby mode to the pressurization mode to 1500 rpm, downtime deletion of 1.2 seconds can be achieved compared with 1.98 seconds when the speed is set to 600 rpm. As a result, since the processing from the motor rotation start to the stop during the shifting of each mode can be completed within 1.4 seconds, recovery time up to image formation including necessary temperature adjustment can be set within 30 seconds. A shifting angle from the pressurization releasing mode to the pressurization mode is small, and thus the recovery time of 30 seconds can be sufficiently achieved even at the slow speed of 600 rpm.

According to the control of the first exemplary embodiment, by setting the shifting speed from the pressurization releasing mode to the pressurization mode lower than that from the standby mode to the pressurization mode, the fixing motor 41 can be stably stopped at a predetermined position. In the first exemplary embodiment, by setting the rotational speed of the fixing motor 41 in the case of shifting from the pressurization releasing mode to the pressurization mode lower than that of the fixing motor 41 in the case of shifting from the standby mode to the pressurization mode, productivity reduction can be reduced.

A second exemplary embodiment will be described.

Figure 14:
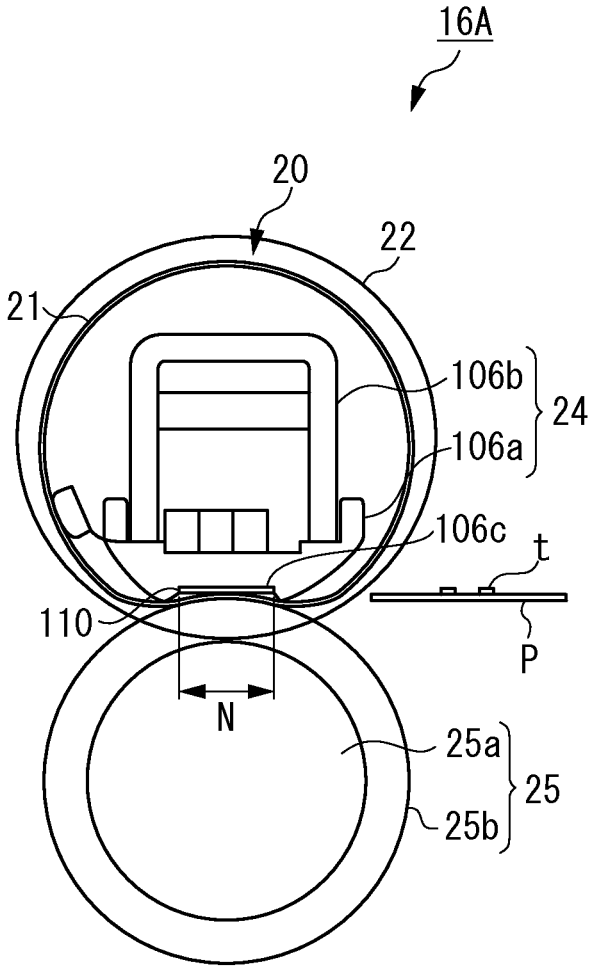
FIG. 14 is an explanatory view illustrating a configuration of a fixing device according to a second exemplary embodiment.

FIG. 14 is a diagram illustrating a configuration of a fixing device according to a second exemplary embodiment. The first exemplary embodiment has been directed to the fixing device 16 of the induction heating type that heats the fixing belt 21 by the alternating magnetic field illustrated in FIG. 2A. The second exemplary embodiment is directed to a fixing device 16A of a resistance heating method that heats a fixing belt 21 on a rear surface of a nip portion N by a ceramic heater 110 illustrated in FIG. 14. The fixing device 16A of the second exemplary embodiment is almost identical to the fixing device 16 of the first exemplary embodiment except for those concerning the heating method of the fixing belt 21. Thus, in FIG. 14, components similar to those of the fixing device 16 of the first exemplary embodiment will be denoted by common reference numerals illustrated in FIGS. 2A and 2B, and repeated description will be omitted.

Japanese Patent Application Laid-Open No. 2002-268414 discusses a fixing device that heats, by using a fixed and supported ceramic heater, a fixing belt slid with the heater. A pressure roller is brought into press contact with the ceramic heater via the fixing belt to form a nip portion. By pinching and conveying a recording medium bearing an unfixed toner image between the fixing belt of the nip portion and the pressure roller, the unfixed toner image is fixed on the recording medium by heat from the ceramic heater via the fixing belt.

As illustrated in FIG. 14, the fixing device 16A of the second exemplary embodiment includes a ceramic heater 110 in a fixing belt unit 20. The ceramic heater 110 employs a basic configuration of a low heat capacity that includes an energized heat generation resistor layer on a substrate surface of a thin and long plate ceramic substrate. Thus, a temperature increases at steep rising characteristics as a whole by energization to the heat generation resistor layer. A press contact member 106*a* and a stay 106*b* constitute a pressurization assist member 24 of the fixing belt 21. The heater 110 is fitted in a groove 106*c* formed in a lower surface of the press contact member 106*a* along a longitudinal direction to be supported.

The fixing belt 21 is a cylindrical endless belt using a heat resistant material for transmitting heat to a recording medium P, a fixing flange 22 is loosely fitted around the outside at both ends in the longitudinal direction, and a longitudinal-direction position is regulated. To improve quick start performance by reducing a heat capacity of the fixing belt, a belt thickness is 100 μm or less, desirably 50 μm or less to 20 μm or more. For the fixing belt 21, a single-layer belt of a fluorine-contained resin material (PTFE, PFA, or FEP) or a composite layer belt prepared by coating an outer peripheral surface of polyimide, polyamideimide, PEEK, PES or PPS with a fluorine-contained resin material (PTFE, PFA, or FEP) may be used. A metallic belt material may also be used.

The fixing device 16A of the second exemplary embodiment rotates the fixing motor 41 in a forward direction to perform a fixing operation during image formation, rotates the fixing motor 41 in a reverse direction during power-OFF, and turns OFF power after pressure releasing of a nip portion N is performed.

The fixing device 16A of the second exemplary embodiment rotates, as illustrated in FIG. 6B, an eccentric cam 32 by 263° in an arrow direction to shift from the standby mode to the pressurization mode. In this case, a rotational speed of a rotational magnetic field of a stator of the fixing motor 41 is set to 1500 rpm.

The fixing device 16A of the second exemplary embodiment rotates, as illustrated in FIG. 6B, the eccentric cam 32 by 113° in the arrow direction to shift from the pressurization releasing mode to the pressurization mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-195669, filed Sep. 6, 2012, which is hereby incorporated by reference herein in its entirety.

What is claimed is:

1. An image forming apparatus comprising:

an image forming unit configured to form an image on a recording medium;

a first rotation member configured to heat the recording medium on which the image has been formed;

a second rotation member;

a pressurization unit configured to apply pressure on the first rotation member or the second rotation member so as to apply pressure on a nip portion formed by the first rotation member and the second rotation member;

a cam configured to receive pressure applied from the pressurization unit according to a rotational position of the cam, and change a pressurizing force applied to the first rotation member or the second rotation member;

a DC motor configured to drive the cam to rotate; and a control unit configured to, in a first mode in which the cam rotates from a first rotational position to a second rotational position by passing through a third rotational position without stopping at the third rotational position, control the DC motor such that a rotational speed of the DC motor reaches a first target rotational speed, and in a second mode in which the cam rotates from the third rotational position to the second rotational position without passing through the first rotational position, control the DC motor such that the rotational speed of the DC motor reaches a second target rotational speed lower than the first target rotational speed, wherein a rotational angle from the first rotational position to the second rotational position is larger than that from the third rotational position to the second rotational position, and p1 wherein a pressurizing force of the pressurization unit at the second rotational position is larger than those of the pressurization unit at the first and third rotational positions.

2. The image forming apparatus according to claim 1, wherein the control unit performs control such that the rotational position of the cam is the second rotational position if an image is formed, the rotational position of the cam is the first rotational position if image formation is in a standby state, and the rotational position of the cam is the third rotational position if the image forming apparatus is in a stopped state, and wherein the pressurizing force of the pressurization unit at the first rotational position is larger than that of the pressurization unit at the third rotational position.

3. The image forming apparatus according to claim 1, wherein a shape of the cam at the second rotational position is flat.

4. The image forming apparatus according to claim 1, wherein if the rotational position of the cam is either the first rotational position or the second rotational position, the first rotation member and the second rotation member are in contact with each other, and a width of the nip portion at the second rotational position is larger than that of the nip portion at the first rotational position, and wherein if the rotational position of the cam is the third rotational position, the first rotation member and the second rotation member are separated from each other.

5. The image forming apparatus according to claim 1, wherein the motor drives the cam to rotate if the motor rotates in a first direction, and drives the second rotation member to rotate if the motor rotates in a second direction different from the first direction.

6. The image forming apparatus according to claim 5, wherein the first rotation member rotates following the second rotation member.

7. The image forming apparatus according to claim 1, further comprising a magnetic field generation unit including a coil and a core and configured to generate a magnetic field, wherein the first rotation member includes a conductive layer and generates heat according to the magnetic field generated by the magnetic field generation unit.

8. The image forming apparatus according to claim 1, wherein the first rotation member is a belt.

9. The image forming apparatus according to claim 1, wherein the second rotation member is a roller including an elastic layer.

10. The image forming apparatus according to claim 1, wherein the DC motor is a DC brushless motor.

* * * * *